US006978099B2

(12) United States Patent
Ueno et al.

(10) Patent No.: US 6,978,099 B2
(45) Date of Patent: Dec. 20, 2005

(54) DEVELOPING APPARATUS, PROCESS CARTRIDGE, AND ELECTROPHOTOGRAPHIC IMAGE FORMING APPARATUS INCLUDING AN ELASTIC MEMBER PREVENTING A GAP BETWEEN A DEVELOPING AGENT CARRIER AND A LAYER THICKNESS LIMITER FROM CHANGING, AND AN ELECTROPHOTOGRAPHIC IMAGE FORMING APPARATUS DETACHABLY MOUNTING SUCH PROCESS CARTRIDGE

(75) Inventors: Takahito Ueno, Shizuoka-ken (JP); Masahide Kinoshita, Shizuka-ken (JP); Atsushi Numagami, Kanagawa-ken (JP); Kazunari Murayama, Shizuoka-ken (JP); Seiji Yamaguchi, Shizuoka-ken (JP); Masao Uyama, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 143 days.

(21) Appl. No.: 10/654,909

(22) Filed: Sep. 5, 2003

(65) Prior Publication Data

US 2005/0191083 A1 Sep. 1, 2005

(30) Foreign Application Priority Data

Sep. 6, 2002 (JP) ..... 2002-261153

(51) Int. Cl.[7] ..... G03G 15/08
(52) U.S. Cl. ..... 399/103; 399/105; 399/284
(58) Field of Search ..... 399/102, 103, 399/105, 274, 284

(56) References Cited

U.S. PATENT DOCUMENTS

| | | | | |
|---|---|---|---|---|
| 5,073,797 A | * | 12/1991 | Ono et al. | 399/105 |
| 5,283,616 A | | 2/1994 | Numagami et al. | |
| 5,383,011 A | | 1/1995 | Numagami et al. | |
| 5,500,714 A | | 3/1996 | Yashiro et al. | |
| 5,543,898 A | | 8/1996 | Shishido et al. | |
| 5,585,895 A | | 12/1996 | Yashiro et al. | |
| 5,589,918 A | | 12/1996 | Oshida et al. | 399/114 |
| 5,682,574 A | | 10/1997 | Oshida et al. | 399/64 |
| 5,768,658 A | | 6/1998 | Watanabe et al. | 399/111 |

(Continued)

FOREIGN PATENT DOCUMENTS

JP 2-173681 7/1990

(Continued)

*Primary Examiner*—William J. Royer
(74) *Attorney, Agent, or Firm*—Fitzpatrick, Cella, Harper & Scinto

(57) ABSTRACT

The present invention relates to a developing apparatus for developing an electrostatic latent image formed on an electrophotographic photosensitive drum using a developing agent, including a developing agent carrier for supplying the developing agent to the photosensitive drum to develop the electrostatic latent image formed on the photosensitive drum, a layer thickness limiting member for limiting the layer thickness of the developing agent carried on a surface of the developing agent carrier, the layer thickness limiting member being disposed with a gap to the developing agent carrier, a sealing member for restricting the developing agent from leaking out of an end in a longitudinal direction of the developing agent carrier, and an elastic member arranged in contact with the developing agent carrier to prevent the gap between the developing agent carrier and the layer thickness limiting member from changing upon bending of the developing agent carrier. The elastic member is in contact with the developing agent carrier at an outer position with respect to a position at which the sealing member is disposed.

12 Claims, 9 Drawing Sheets

U.S. PATENT DOCUMENTS

| | | | | |
|---|---|---|---|---|
| 5,790,923 | A | 8/1998 | Oguma et al. | 399/106 |
| 5,920,753 | A | 7/1999 | Sasaki et al. | 399/111 |
| 5,966,568 | A | 10/1999 | Numagami et al. | 399/111 |
| 6,016,413 | A | 1/2000 | Yokoyama et al. | 399/113 |
| 6,097,909 | A | 8/2000 | Watanabe et al. | 399/111 |
| 6,101,354 | A | 8/2000 | Nakagawa et al. | 399/225 |
| 6,131,007 | A | 10/2000 | Yamaguchi et al. | 399/256 |
| 6,131,011 | A | 10/2000 | Kojima et al. | 399/351 |
| 6,169,866 | B1 | 1/2001 | Watanabe et al. | 399/111 |
| 6,185,392 | B1 * | 2/2001 | Hoshi | 399/102 |
| 6,246,849 | B1 | 6/2001 | Yokoyama et al. | 399/117 |
| 6,266,500 | B1 | 7/2001 | Numagami et al. | 399/104 |
| 6,266,503 | B1 | 7/2001 | Murayama et al. | 399/117 |
| 6,272,299 | B1 | 8/2001 | Numagami et al. | 399/111 |
| 6,289,189 | B1 | 9/2001 | Numagami et al. | 399/111 |
| 6,298,217 | B1 | 10/2001 | Murayama et al. | 399/358 |
| 6,314,266 | B1 | 11/2001 | Murayama et al. | 399/353 |
| 6,385,416 | B1 | 5/2002 | Horikawa et al. | 399/111 |
| 6,496,664 | B1 | 12/2002 | Ogata et al. | 399/62 |
| 6,577,831 | B1 | 6/2003 | Kojima et al. | 399/111 |
| 6,608,980 | B2 | 8/2003 | Murayama et al. | 399/110 |
| 6,823,153 | B2 * | 11/2004 | Ueno et al. | 399/103 |
| 6,839,529 | B2 * | 1/2005 | Yasui et al. | 399/103 |

FOREIGN PATENT DOCUMENTS

| | | |
|---|---|---|
| JP | 5-27574 | 2/1993 |
| JP | 2002-214919 | 7/2002 |
| JP | 2002-244425 | 8/2002 |

* cited by examiner

DEVELOPING APPARATUS, PROCESS CARTRIDGE, AND ELECTROPHOTOGRAPHIC IMAGE FORMING APPARATUS INCLUDING AN ELASTIC MEMBER PREVENTING A GAP BETWEEN A DEVELOPING AGENT CARRIER AND A LAYER THICKNESS LIMITER FROM CHANGING, AND AN ELECTROPHOTOGRAPHIC IMAGE FORMING APPARATUS DETACHABLY MOUNTING SUCH PROCESS CARTRIDGE

BACKGROUND OF THE INVENTION

1. Field of the Invention

This invention relates to a developing apparatus and a process cartridge, which are used in an electrophotographic image forming apparatus, and to an electrophotographic image forming apparatus using those apparatuses.

Herein, the electrophotographic image forming apparatus means an apparatus for forming images on a recording medium using an electrophotographic image forming process. For example, the electrophotographic image forming apparatus includes, e.g., an electrophotographic photocopier, an electrophotographic printer (e.g., LED printer, laser beam printer), an electrophotographic facsimile machine, and an electrophotographic word processor.

The process cartridge discussed herein refers to an apparatus made as a cartridge integrated with at least a developing apparatus and an electrophotographic photosensitive drum to be detachably mountable to an image forming apparatus body (the main assembly of the image forming apparatus). The developing apparatus discussed herein refers to an apparatus made as a cartridge integrated with a toner container and a developing means to be detachably mounted to an image forming apparatus body.

2. Description of Related Art

A process cartridge system has been used conventionally in which an electrophotographic photosensitive member and a developing means are integrated into a cartridge to be detachably mounted to an image forming apparatus body.

With such a cartridge method, the controllability is further improved to allow users themselves to easily do maintenance work on a processing means. This cartridge method is consequently used widely for image forming apparatus.

A cartridge structure is also realized in which processing means are divided into ones having a longer duration and ones having a shorter duration and are made into cartridges to be used according to the length of the duration of a main processing means. For example, a developing cartridge integrated with a toner container and a developing means, and a drum cartridge integrating an electrophotographic photosensitive drum, a charging means, and a cleaning means are used.

With such a cartridge, as a conventional developing method, a so-called magnetic brush developing method has been known. In this method, first, a two-component developing agent made of a non-magnetic toner and a magnetic carrier is used. A magnetic brush is formed on a surface of a developing agent carrier (hereinafter referred to as "developing sleeve") in which a magnet is disposed inside. This magnetic brush is made to rub on or is placed adjacently to the photosensitive drum facing to the developing sleeve with a small developing gap. In continuous application of an electric field between the developing sleeve and the photosensitive drum, development is performed by transferring and reverse transferring toner particles between the developing sleeve and the photosensitive drum repeatedly.

It is to be noted that a plate shaped metal member made of a non-magnetic material or a magnetic material is used as a layer thickness limiting member (hereinafter referred to as "blade") for limiting a layer thickness of a magnetic brush formed of the two-component developing agent. Adjustment of a gap determining the layer thickness of the magnetic brush, or namely the gap between the developing sleeve and the layer thickness limiting member (hereinafter also referred to as "SB gap") is easy where the blade's surface facing the developing sleeve orients toward the center of the developing sleeve. Therefore, such a structure is conventionally used widely and described in, e.g., Japanese Patent Application Publications (Laid Open) No. 2002-214,919, No. 2002-244,425, No. Heisei 02-173,681, and No. Hei 05-027,574.

However, the above structure has a very small SB gap, 200 to 500 microns. Therefore, during transportation of the products, the developing sleeve may be bent to shift the SB gap. Such a shift in the SB gap may bring inferior quality of images.

SUMMARY OF THE INVENTION

This invention is to solve the above problems. It is an object of the invention to provide a developing apparatus, a process cartridge, and an electrophotographic image forming apparatus, which are preventable of contact or collision between a developing agent carrier and a layer thickness limiting member.

It is another object of the invention to provide a developing apparatus, a process cartridge, and an electrophotographic image forming apparatus, which can keep constant the gap between the developing agent carrier and the layer thickness limiting member.

DETAILED DESCRIPTION OF THE PREFERRED EMBODIMENTS

Hereinafter, a developing apparatus, a process cartridge, and a color electrophotographic image forming apparatus according to an embodiment of the invention is described in reference with the drawings. In the description below, the longitudinal direction is a direction perpendicular to the conveyance direction of a recording medium 52 and a direction the same as an axial direction of an electrophotographic photosensitive member (hereinafter, referred to as "photosensitive drum 2"). The term "right and left" means the right and left direction when seen from the conveyance direction of the recording medium 52. The upper and lower sides are the upper and lower sides when the cartridge is mounted.

[Description of the Entire Image Forming Apparatus]

First, referring to FIG. 1 to FIG. 4, the entire structure of the color electrophotographic image forming apparatus is described.

Figure 1:
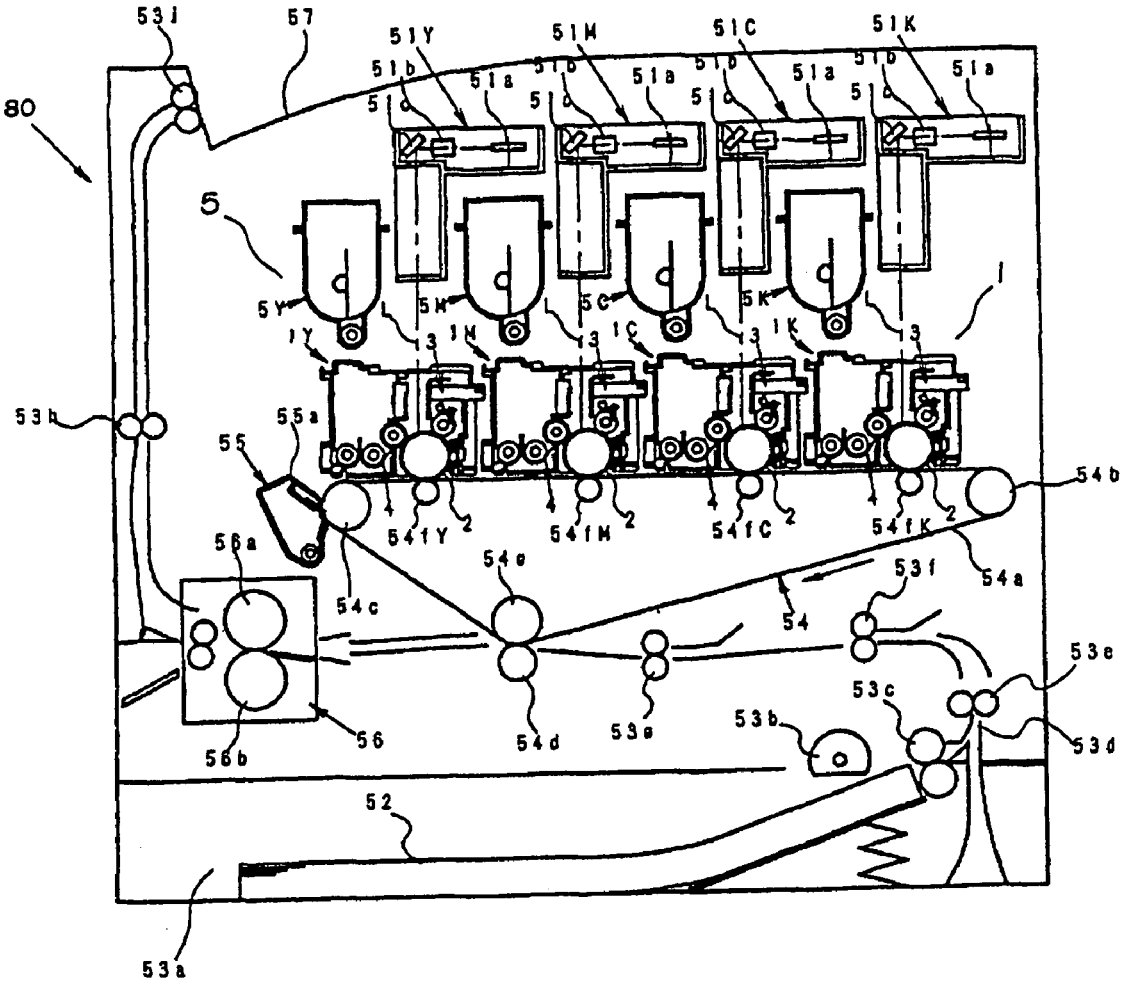
FIG. 1 is an illustration showing the whole structure of a color laser beam printer as an embodiment of a color image forming apparatus.
Figure 2:
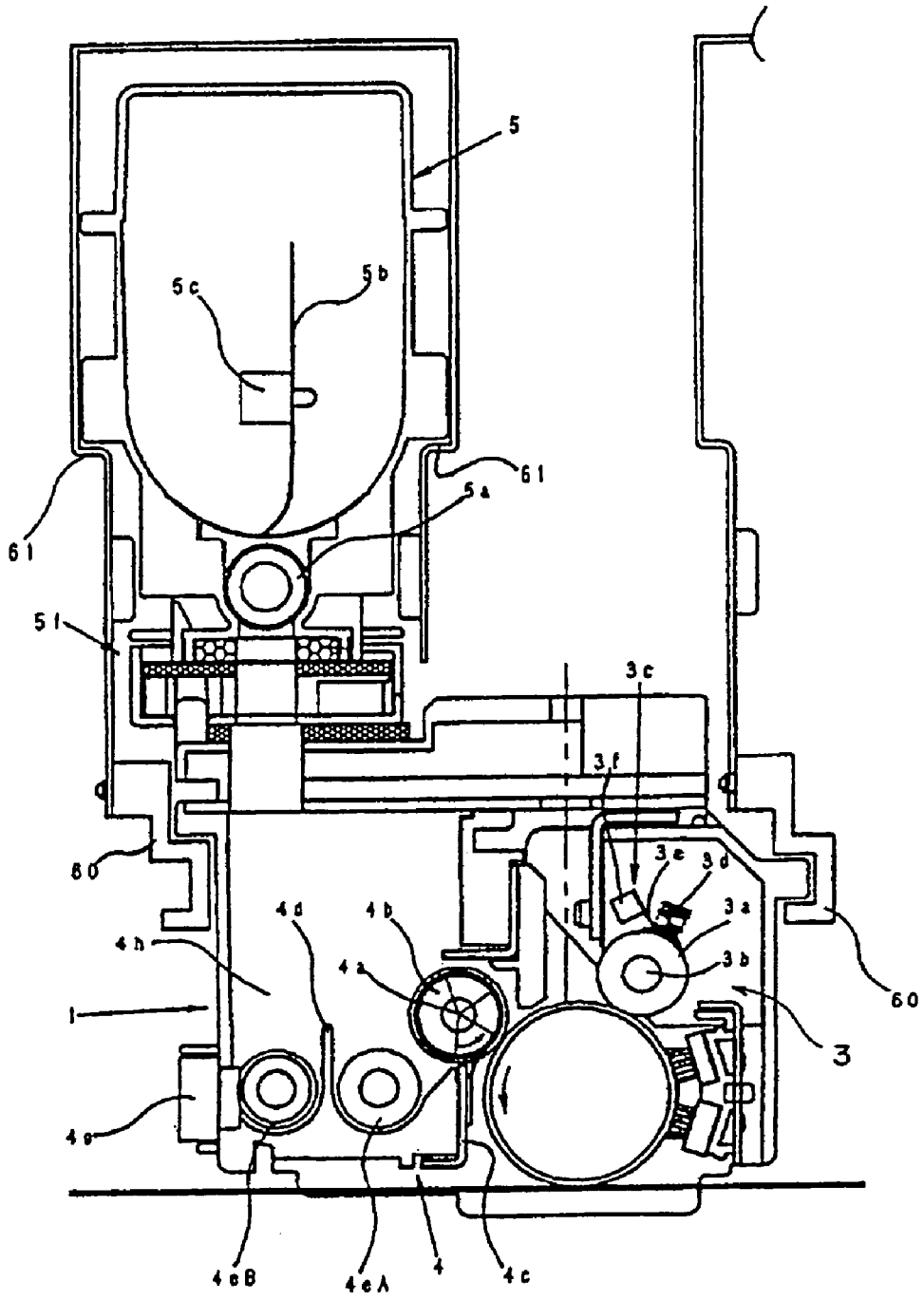
FIG. 2 is a cross section showing a process cartridge and a toner supply container.
Figure 3:
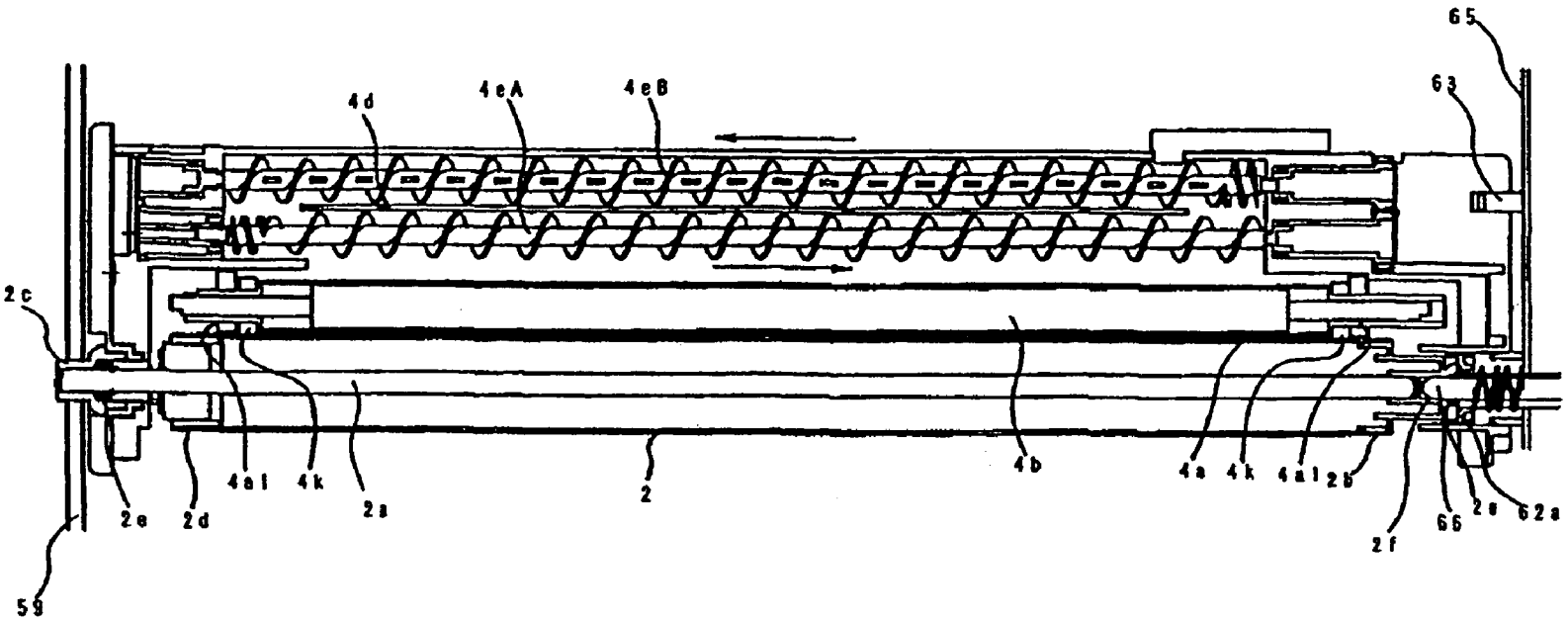
FIG. 3 is a longitudinal cross section showing the process cartridge.
Figure 4:
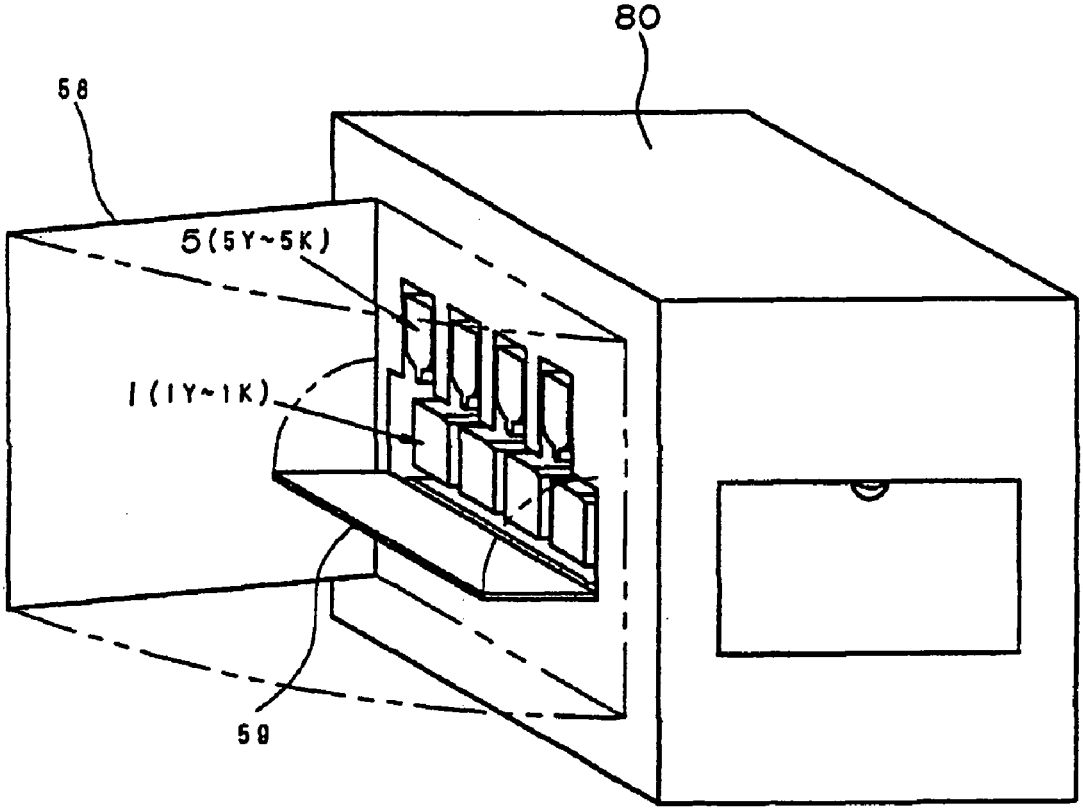
FIG. 4 is a schematic perspective view showing an image forming apparatus body.

FIG. 1 is an illustration showing the whole structure of a color laser beam printer as an embodiment of a color toner image forming apparatus; FIG. 2 is a cross section showing a process cartridge and a toner supply container; FIG. 3 is a longitudinal cross section showing the process cartridge; FIG. 4 is a schematic perspective view showing an image forming apparatus body.

In an image forming section of this color laser beam printer, as shown in FIG. 1, respectively arranged parallel are four process cartridges 1 (1Y, 1M, 1C, 1K; yellow, magenta, cyan, black) each having a photosensitive drum 2, and exposing means 51Y, 51M, 51C, 51K (laser beam optical Scanning system) corresponding to the respective colors.

A feeding means for feeding the recording medium 52, an intermediate transfer belt 54*a* for transferring a toner image formed on the photosensitive drum 2, and a secondary transfer roller 54*d* for transferring the toner image on the intermediate transfer belt 54*a* to the recording medium 52 are arranged below the image forming section.

A fixing means for fixing the recording medium 52 to which the toner image is transferred, and a delivering means for delivering the recording medium 52 out of the apparatus and stacking the recording medium, are arranged.

Herein, as the recording medium 52, exemplified are paper, OHP sheets, and fabric.

The image forming apparatus according to the invention is an apparatus of a non-cleaner type system, and the transfer remaining toner remaining on the photosensitive drum 2 is taken by the developing means. Therefore, no special cleaner for collecting and storing the transfer remaining toner is arranged within the process cartridge.

Next, structures of respective portions in the image forming apparatus are described in detail.

[Conveying Means]

The conveying means feeds the recording medium 52 to the image forming section. This conveying means includes a feeding cassette 53*a* containing plural recording media 52 in a stacking fashion, a feeding roller 53*b*, a retard roller 53*c* preventing sheets from being doubly fed, a feeding guide 53*d*, conveyance rollers 53*e*, 53*f*, and registration rollers 53*g*.

The feeding roller 53*b* rotatively drives in response to an image formation operation. The recording medium 52 is fed separately one by one. The recording medium 52 is guided with the feeding guide 53*d* and conveyed to the registration rollers 53*g* via the conveyance rollers 53*e*, 53*f*.

The registration rollers 53*g* stop rotating right after the recording medium 52 is conveyed. Therefore, the recording medium 52 is corrected from being fed obliquely upon hitting the nipping portion.

The registration rollers 53*g* perform a non-rotational operation for stationary holding the recording medium 52 and a rotational operation for conveying the recording medium 52 toward the intermediate belt 54*a* according to a prescribed sequence during the image formation operation. This operation aligns the toner image during the transfer process as a subsequent process and the recording medium 52.

The process cartridge 1 is structured in a united body in arranging a charging means and a developing means around the photosensitive drum 2. This process cartridge 1 can be replaced by the user easily with respect to the apparatus body and when the photosensitive drum 2 ends the duration, the process cartridge 1 is to be replaced.

In this embodiment, for example, it is detected that the process cartridge 1 ends the duration when, upon counting up the rotary number of the photosensitive drum 2, the counted number exceeds a prescribed number.

The photosensitive drum 2 according to this embodiment is an organic photosensitive member charged negatively and having a photosensitive layer used ordinarily on a drum base made of aluminum with a diameter around 30 mm and a charge introduction layer at a topmost layer. The photosensitive drum 2 is driven to rotate at a prescribed rate, or namely about 117 mm/sec in this embodiment.

As shown in FIG. 3, a drum flange 2*b* is secured at a rear side end of the photosensitive drum 2, and a non-drive flange 2*d* is secured to a front end. A drum shaft 2*a* is penetrated through the center of the flanges 2*b*, 2*d*. The drum shaft 2*a* rotates unitedly with the flanges 2*b*, 2*d*. That is, the photosensitive drum 2 rotates around a center of the drum shaft 2*a*.

The front side end of the drum shaft 2*a* is supported rotationally to a bearing 2*e*. This bearing 2*e* is secured to the bearing casing $2c_1$ The bearing casing 2*c* is secured to the frames of the cartridges 1Y, 1M, 1C, 1K.

[Charging Means]

The charging means 3 is a device using a contact charging method. In this embodiment, a charging roller 3*a* is used as a charging member.

As shown in FIG. 2, in this charging roller 3*a*, the opposite ends of a metal core 3*b* are rotatably held at bearings, not shown. The charging roller 3*a* is urged by a pushing spring 3*d* toward the photosensitive drum 2, and makes pressurized contact with the surface of the photosensitive drum 2 with a prescribed pressure. The charging roller 3*a* rotates according to rotation of the photosensitive drum 2.

Numeral 3*c* is a charging roller cleaning member and is a cleaning film 3*e* having a flexible property in this embodiment. The film 3*e* is arranged parallel to the longitudinal direction of the charging roller 3*a*, and one end is secured to a supporting member 3*f* reciprocally movable in a prescribed amount with respect to the longitudinal direction. The film 3*e* forms a contact nip on a surface adjacent to a free end side. The surface of the charging roller 3*a* is rubbed with the film 3*e* upon reciprocally driving the supporting member 3*f* by a prescribed amount in the longitudinal direction with a driving means, not shown. This removes attached objects such as fine particle toners, additives or the like on the surface of the charging roller 3*a*.

[Exposing Means]

In this embodiment, exposure of the photosensitive drum 2 is done with a laser exposing means. That is, where an image signal is sent from the image forming apparatus body, laser beam L modified corresponding to this signal is scanned to expose an unified charging surface of the photosensitive drum 2. An electrostatic latent image is selectively firmed on a surface of the photosensitive drum 2 according to the image information.

The laser exposing means includes, e.g., a solid state laser device, not shown, a polygon mirror 51*a*, a converging lens 51*b*, and a reflective mirror 51*c*. The solid state laser device is controlled to be turned on and off as to emit light at a prescribed timing according to a light emitting signal generator, not shown, based on an inputted image signal. The laser beam L emitted from the solid state laser device is converted into a substantially parallel light flux by a collimator lens system, not shown, and is scanned with the rotating polygon mirror 51*a*. The laser beam L is then converged in a spot shape on the photosensitive drum 2 via the lens 51*b* and the mirror 51*c*.

An exposure profile according to the image signal is obtained on the surface of the photosensitive drum 2 upon exposure in a main scanning direction by means of the laser beam L scanning and upon exposure in a subsidiary scanning direction done by rotation of the photosensitive drum 2.

That is, radiation and non-radiation of the laser beam L form a bright level at which the surface potential is dropped as well as a dark level at which the surface potential is not dropped. By the contrast between the bright level and the dark level, an electrostatic latent image is formed corresponding to the image information.

[Developing Means]

The developing apparatus 4 as a developing means is a two-component contacting developing apparatus (two-component magnetic brush developing apparatus). As shown in FIG. 2, a developing agent made of a carrier and a toner is held on a developing sleeve 4*a* as a developing agent carrier incorporating a magnet roller 4*b*. A limiting blade 4*c* is provided at the developing sleeve 4*a* with a prescribed gap(space). According to the rotation in a direction of the arrow of the developing sleeve 4*a*, the developing agent in a thin layer is formed on the developing sleeve 4*a*.

On the developing sleeve 4*a*, spacers 4*k* are rotatably fitted to journal portions 4*a*1 having a shorter diameter at the opposite ends of the developing sleeve 4*a* as shown in FIG. 3. This renders the developing sleeve 4*a* aligned with a prescribed gap(space) to the photosensitive drum 2. The developing agent formed on the developing sleeve 4*a* is developed during the development in a state that contacting to the photosensitive drum 2. The developing sleeve 4*a* is rotatably driven at a prescribed circumferential rate in a clockwise direction as shown with the arrow as the direction reverse to the rotational direction of the photosensitive drum 2 at the developing section.

The toner used in this embodiment is made of a negatively charged toner having an average diameter of 6 microns and a magnetic carrier having an average diameter of 35 microns with a saturated magnetization of 205 emu/cm$^3$. A mixture of the toner and the carrier of ratio of 6 to 94 by weight is used as the developing agent.

A developing agent container 4*h* at which the developing agent is circulated is divided into two parts by a diaphragm 4*d* extending in the longitudinal direction except the opposite ends. Stirring screws 4*e*A, 4*e*B are disposed astride the diaphragm 4*d*.

The toners supplied from the toner supplying containers 5 (5Y, 5M, 5C, 5K fall off at a rear side of the stirring screw 4*e*B, are stirred as fed forward in the longitudinal direction, and pass through a portion at which no diaphragm 4*d* is arranged on a front side. The toners are further fed in the longitudinal direction with the stirring screw 4*e*A to pass though a portion at which no diaphragm 4*d* on a rear side is located, and are stirred as fed with the stirring screw 4*e*B, thereby repeating the circulation.

The electrostatic latent image formed on the photosensitive drum 2 are described with respect to a developing process visualizing the image in use of the developing apparatus 4 by a two-component magnetic brush method and with respect to a circulation system of the developing agent.

According to the rotation of the developing sleeve 4*a*, the developing agent in the developing agent container 4*h* is conveyed upon sucked up onto the surface of the developing sleeve 4*a* at a pole for sucking up of the magnet roller 4*b*.

The layer thickness of the developing agent is restricted with the limiting blade 4*c* disposed perpendicularly with respect to the developing sleeve 4*a* during the midway of the conveyance, thereby forming the thin layered developing agent on the developing sleeve 4*a*. When the thin layered developing agent is conveyed to a developing pole corresponding to the developing section, the developing agent stands upright due to the magnetic force. The electrostatic latent image on the surface of the photosensitive drum 2 is developed as a toner image by the toner in the developing agent formed to stand upright. In this example, the electrostatic image is developing in the reverse manner.

The thin layered developing agent provided on the developing sleeve 4*a* and passed through the developing portion, further enters in the developing agent container 4*h* according to the rotation of the developing sleeve 4*a*. The agent is returned to the developing agent reservoir in the developing agent container 4*h* upon separating from the developing sleeve 4*a* by resilient magnetic field at a conveyance pole.

Direct current voltage and alternative current voltage are given from a power source, not shown, to the developing sleeve 4*a*. In this embodiment, a direct current voltage of −500 V and an alternative current voltage with an peak to peak voltage of 1500V, and a frequency of 2000 Hz, are applied to selectively develop only the exposed section of the photosensitive drum 2.

When the toner is consumed by the development, the toner density in the developing agent is lowered. In this embodiment, a sensor 4*g* for detecting the toner density is disposed at a position near the outer peripheral surface of the stirring screw 4*e*B. The sensor 4*g* detects whether the toner density in the developing agent lower than the prescribed density level. According to this detection, an instruction to supply the toner in the developing apparatus 4 from the toner supply container 5 is given. The toner density of the developing agent is managed to be kept at the prescribed level from this toner supplying operation.

[Toner Supplying Container]

The toner supplying containers 5 (5Y, 5M, 5C, 5K) structuring the toner supplying means 5 are parallel arranged over the cartridges 1 (1Y, 1M, 1C, 1K). Those containers 5 are mounted from the front surface of the apparatus body (the main assembly of the image apparatus) 80.

As shown in FIG. 2, a stirring plate 5*b* secured to a stirring shaft 5*c* and a screw 5*a* are disposed inside the supplying container 5. A drain opening 5*f* is provided for delivering the toner out at a bottom of the container 5.

The screw 5*a* and the stirring shatft 5*c* are supported so as to be rotatable at a bearing located at the opposite ends, and a drive coupling (female type) is provided at a tip on one side. The drive coupling (female type) receives a drive force from a drive coupling (male type), and is rotationally driven. The outer shape of the screw 5*a* is in a spiral rib shape. In this screw 5*a*, the twisting direction of the spiral shape is reversed at the drain opening 5*f* as a center. According to the rotation of the coupling (male type), the screw is rotated in a prescribed rotational direction.

The toner is conveyed toward the drain opening 5*f* and freely dropped from the opening of the drain opening 5*f*, thereby supplying the toner to the process cartridge 1. The tip in the rotational radius direction of the stirring plate 5*b* is inclined. When sliding on a wall surface of the toner supplying container 5, the tip is in contact with the wall surface with a certain angle.

More specifically, the tip side of the stirring plate 5*b* is twisted and assumes a spiral state. Thus, the tip side of the stirring plate 5*b* is inclined in a twisted manner to generate a conveyance force toward the shaft direction, thereby feeding the toner in the longitudinal direction.

It is to be noted that the toner supplying container 5 in this embodiment not only employs the two-component developing method but also can supply toner for a process cartridge or a developing cartridge using a single component developing method. The particles contained in the toner supplying container are not only toners but also so called developing agents in which the toner and the magnetic carrier are mixed, as a matter of course.

[Transferring Means]

An intermediate transfer unit 54 as a transferring means is for secondary transferring to the recording medium 52 at once the plural toner images overlapped upon primary transfer sequentially from the photosensitive drum 2.

The intermediate transfer unit 54 has an intermediate transfer belt 54*a* running toward the arrow direction in FIG. 1. The belt 54*a* drives is driven in the clockwise direction of the arrow at substantially the same peripheral rate as the outer peripheral rate of the photosensitive drum 2. The belt 54*a* is an endless belt having a peripheral length of about 940 mm and is tensioned by three rollers of a drive roller 54*b*, a secondary transfer roller 54*g*, and a driven roller 54*c*.

In the belt 54*a*, transfer charging rollers 54*f*Y, 54*f*M, 54*f*C, and 54*f*K are disposed as rotatable at respective facing positions of the photosensitive drums 2 and are pressed in a direction toward the center of each photosensitive drum 2.

The rollers 54*f*Y, 54*f*M, 54*f*C, 54*f*K are powered by a high voltage power supply, not shown, and are charged at a polarity opposite to the toner from the rear side of the belt 54*a*. The toner images on the photosensitive drum 2 are primary transferred on a top surface of the belt 54*a* sequentially.

The secondary transfer roller 54*d* serving as a transfer member at the secondary transfer section is in pressurized contact with the belt 54*a* at a position facing a secondary transfer roller 54*g*. The roller 54*d* can be rocking in an up and down direction as shown in drawings and can be rotated. At that time, a bias is applied to the belt 54*a* at the same time, so that the toner image on the belt 54*a* is transferred onto the recording medium 52.

The belt 54*a* and the roller 54*d* are respectively driven. When the recording medium 52 enters in the secondary transfer section, a prescribed bias is applied to the secondary transfer roller 54*d*. This renders the toner image on the belt 54*a* transferred secondary to the recording medium 52.

At that time, the recording medium 52 in a state sandwiched between the belt 54*a* and the roller 54*d* is subject to a transfer process. At the same time, the recording medium 52 is further conveyed at a prescribed rate in a left direction in the drawing and conveyed toward the fixing device 56 for the subsequent process.

A cleaning blade 55*a* is disposed for removing the transfer remaining toner in the unit 55. The unit 55 is attached to be capable of rocking at a rotary center, not shown. The blade 55a is in pressurized contact in a direction engaging the belt 54*a*. The transfer remaining toner collected in the unit 55 is conveyed to a waste toner tank, not shown, by a feeding screw and is stored.

The toner image formed at the photosensitive drum 2 by the developing apparatus 4 is transferred onto the recording medium 52 by the belt 54*a*. The fixing device 56 renders the toner image that has been transferred to the recording medium 52, fixed to the recording medium 52 with heat.

[Fixing Section]

The toner image formed at the photosensitive drum 2 by the developing apparatus is transferred onto the recording medium 52 by the belt 54*a*. The fig device 56 renders the toner image that has been transferred to the recording medium 52, fixed to the recording medium 52 with heat.

As shown in FIG. 1, the fixing device 56 includes a fixing roller 56*a* for applying heat to the recording medium 52, and a pressing roller 56*b* for pressing the recording medium 52 to the fixing roller 56*a*. The respective rollers are hollow rollers. A heater, not shown, is provided inside of each roller. Both of the rollers convey the recording medium 52 at the same time upon driven to rotate.

That is, the recording medium 52 holding the toner image is conveyed with the fig roller 56*a* and the pressing roller 56*b*. The toner image is fixed to the recording medium 52 in application of heat and pressure. The recording medium 52 after fixture is delivered with delivery rollers 53*h*, 53*j* and is stacked on a delivery section 57 on the apparatus body 80.

[Mounting of Process Cartridge and Toner Supplying Container]

Mounting steps for the process cartridge 1 (1Y, 1M, 1C, 1K) and the toner supplying container 5 (5Y, 5M, 5C, 5K are described in reference to FIG. 2 through FIG. 4.

As shown in FIG. 4, an openable front door 58 is disposed on a front side of the apparatus body 80. Where the front door 58 is opened, an opening is exposed for inserting the process cartridge 1 and the toner supplying container 5.

A core defining plate 59 supported rotatably is disposed at the opening for inserting the process cartridge 1, and when the process cartridge 1 is inserted and pulled out, such operation is done after the core defining plate 59 is released.

In the apparatus body 80, as shown in FIG. 2, guide rails 60 serving as an mounting means for guiding the mounting of the cartridge 1 and guide rails 61 for guiding the mounting of the toner supplying container 5 are secured.

The mounting direction of the process cartridge 1 and the toner supplying container 5 in parallel to the axial direction of the photosensitive drum 2, and the guide rails 60, 61 are extending in substantially the same direction. The process cartridge 1 and the toner supplying container 5 are made sliding from the front side to the rear side in the apparatus body 80 along the guide rails 60, 61 once and then inserted.

Where the process cartridge 1 is inserted to the rearmost portion, a core defining shaft 66 of the apparatus body 80 is inserted to a center hole 2*f* of a drum flange 2*b* as shown in FIG. 3. The rotational center position on the rear side of the photosensitive drum 2 is determined with respect to the apparatus body 80. At the same time, a drive transmission portion 2*g* formed at the flange 2*b* and a drive coupling (male type) 62*a* are coupled with each other to render the photosensitive drum 2 rotatable.

The drive transmission portion 2*g* used in this embodiment is in a twisted prism shape; drive is transmitted upon application of the drive force from the body; the portion 2*g* generates force for ping the photosensitive drum 2 into the rear side.

A support pin 63 for positioning the process cartridge 1 is disposed at a rear side plate 65. This support pin 63 is inserted in the frame of the process cartridge 1 to secure the position of the frame of the process cartridge 1.

The rotatable core defining plate 59 is disposed on a front side of the apparatus body 80. A bearing casing 2*c* of the process cartridge 1 is supported and secured with respect to the core defining plate 59. According to those serial operations for insertion, the photosensitive drum 2 and the process cartridge 1 are positioned with respect to the apparatus body 80.

When the toner supplying container 5 is inserted to the rearmost portion, the toner supplying container 5 is secured to a support pin projecting from the rear side plate 65. At the same time, the drive coupling (female type) and the drive coupling (male type) are coupled for transmitting the drive force to the screw 5*a* and the stirring shaft 5*c*. The screw 5*a* and the stirring shaft 5*c* are set to be rotatable.

[End Structure of Developing Sleeve]

Figure 5:
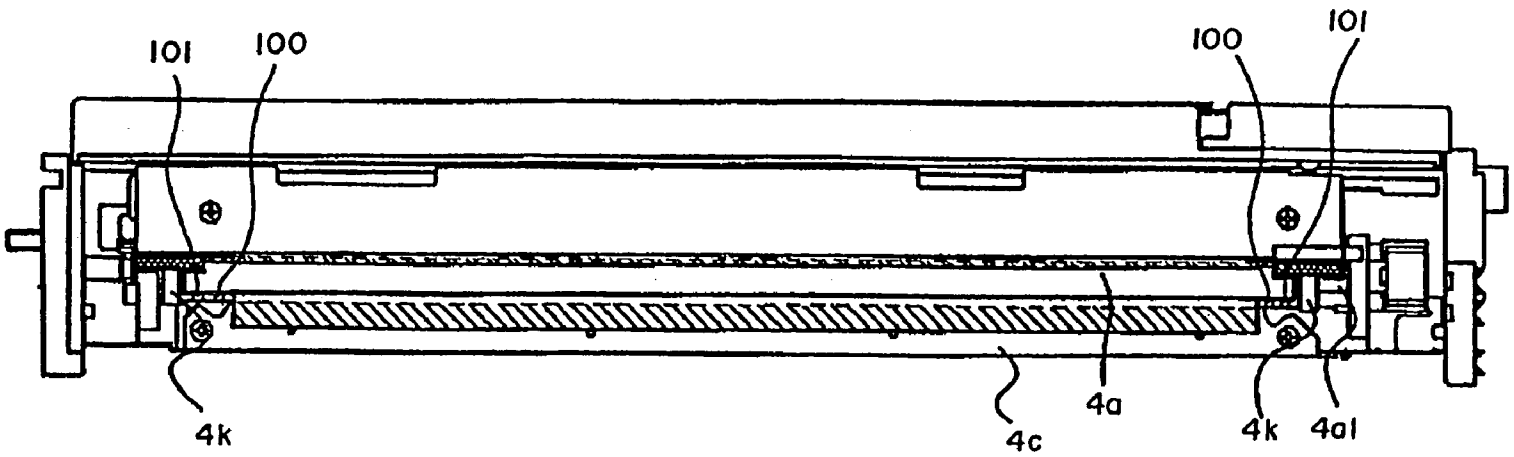
FIG. 5 is a longitudinal schematic view showing a developing apparatus (developing container)
Figure 6:
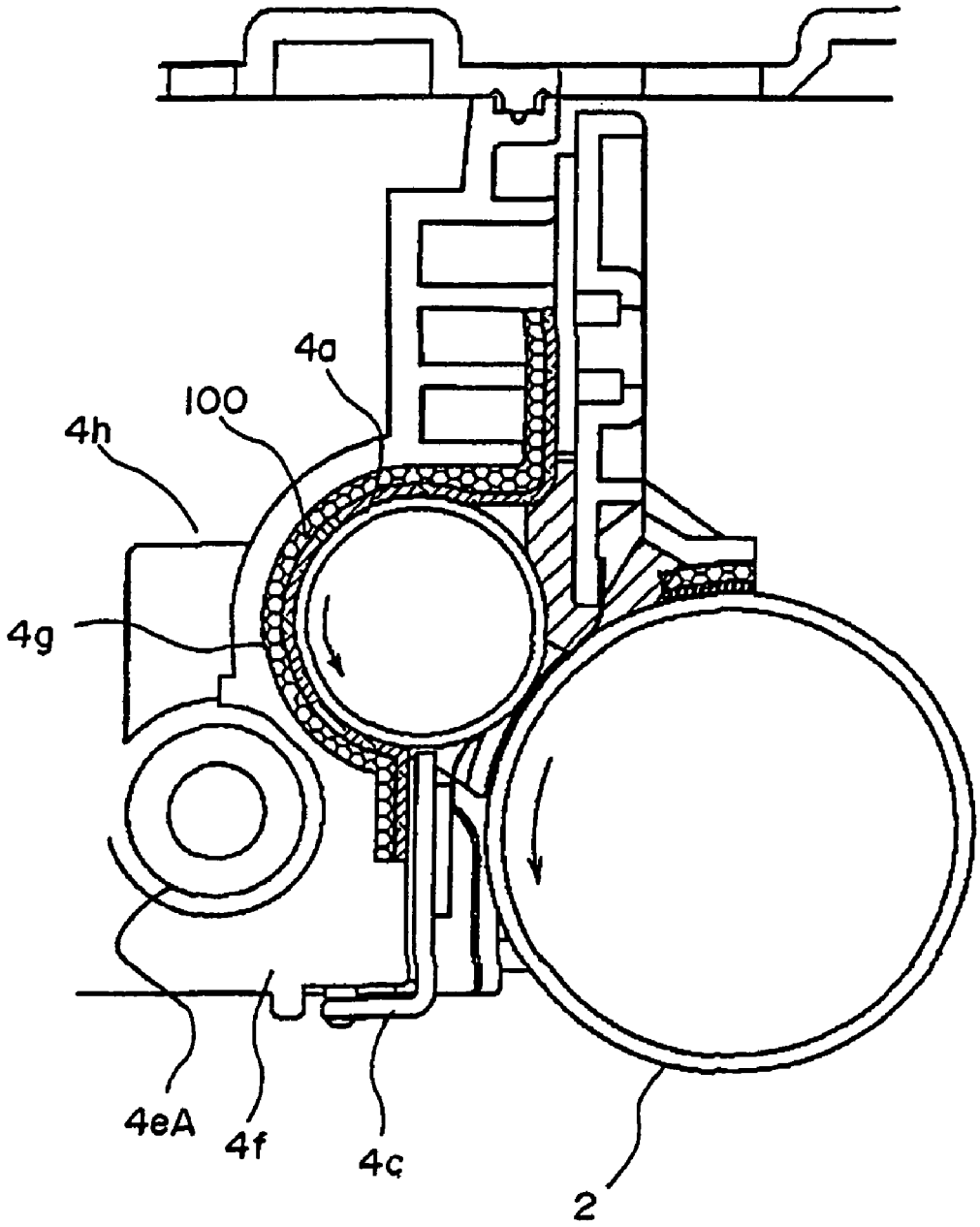
FIG. 6 is a cross section showing the vicinity of a sealing member provided on each side of a developing sleeve.
Figure 7:
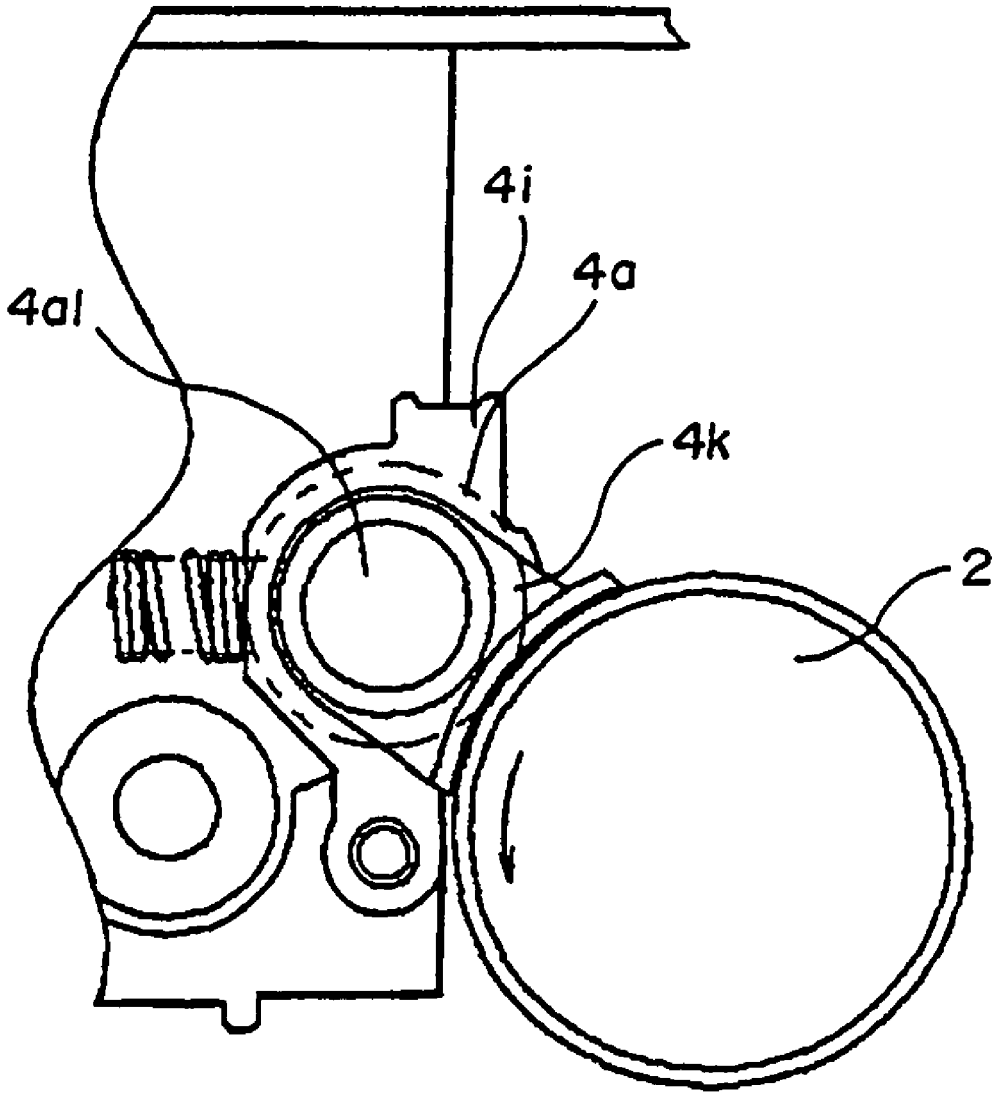
FIG. 7 is a cross section showing the vicinity of the developing sleeve.
Figure 8:
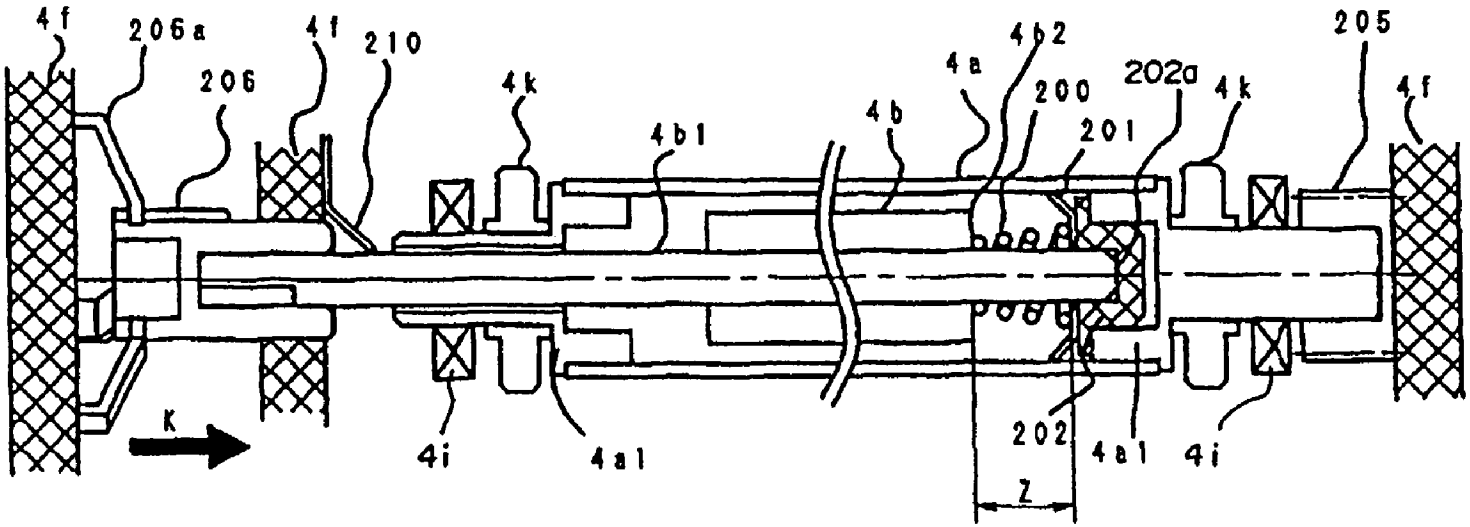
FIG. 8 is a cross section showing a sleeve unit.
Figure 9:
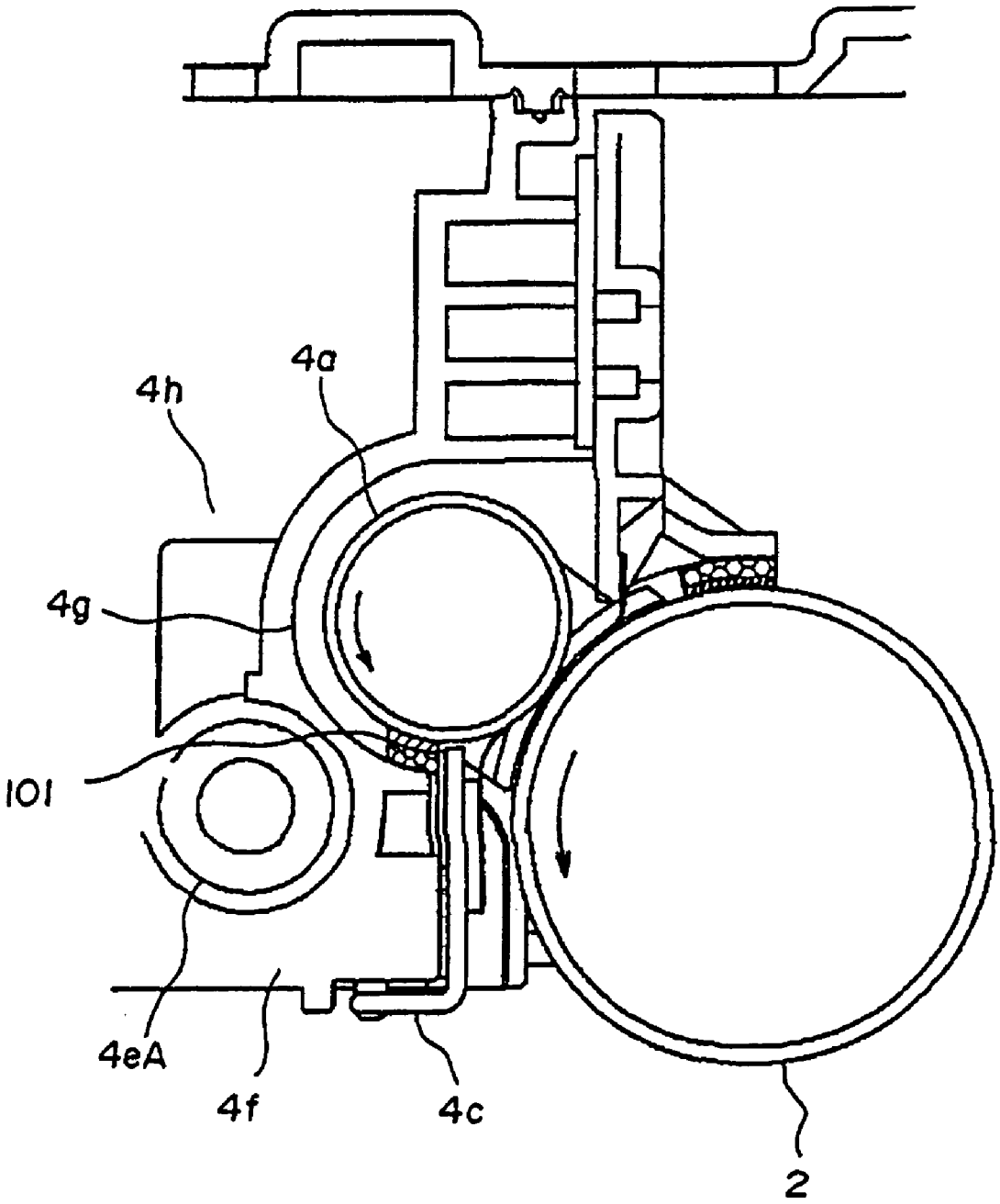
FIG. 9 is a cross section showing the vicinity of an elastic member on each side of the developing sleeve.

Referring to FIGS. 5 to 9, the embodiment of the invention is described. FIG. 5 is a longitudinal schematic view showing a developing apparatus (developing container); FIG. 6 is a cross section showing the vicinity of a sealing member provided on each side of a developing sleeve; FIG. 7 is a cross section showing the vicinity of the developing sleeve; FIG. 8 is a cross section showing a sleeve unit; and FIG. 9 is a cross section showing the vicinity of an elastic member on each side of the developing sleeve.

As shown in FIG. 5 and FIG. 6, a developing agent sealing member 100 is disposed adjacent the opposite ends in the longitudinal direction of the developing sleeve 4*a* for preventing the toner from leaking. The sealing member 100 has a three-layered structure in which: the surface is a felt material; the second layer is a foamed polyurethane as an elastic body; and the third layer is a double side tape.

The sealing member 100 is secured to an arc portion of the developing apparatus located with a prescribed gap to the circumference of the developing sleeve 4*a* with the double side tape. This prevents the toner from leaking and scattering out of the end of the developing sleeve 4*a*. The arc portion of the developing apparatus is located at the opposite ends in the longitudinal direction of the opening of a developing agent container 4*h*.

According to the rotation of the developing sleeve 4*a*, the developing agent in the developing container is sucked up to the surface of the developing sleeve 4*a* at a sucking pole of the magnet roller 4*b* and is conveyed. An one end of the magnet roller 4*b* is supported in the developing sleeve 4*a*.

For the developing sleeve 4*a*, current and voltage of high voltage is needed for operating the functions thereof. As shown in FIG. 8, power supply is made by connection from a feeding metal plate 210 to an end shaft 4*b*1 of the magnet roller 4*b*. A contact spring 200 secured and supported to the end shaft 4*b*1 upon pressingly inserted and electrically connected is mounted thereat. The contact spring 200 and a contact metal plate 201 being supported in the developing sleeve 4*a* and contacting to the inner surface of the developing sleeve 4*a* are made to slide as they are rotated. The contact spring 200 is sandwiched at a gap Z between the contact metal plate 201 and an end surface on the magnet roller 4*b*, and the contact pressure is obtained upon contraction to make an electrical connection. This connection allows power supply to the developing sleeve 4*a* from the metal plate 210. The end shaft 4*b*1 of the magnet roller 4*b* is made of a conducting material or has a structure having a conducting material at the outer periphery of the end shaft 4*b*1.

The end shaft 4*b*1 to which the contact spring 200 is attached is fitted and supported as to be coaxial to the developing sleeve 4*a* with a metal plate supporting member 202 which supports the contact metal plate 201. This makes a positional center shift between the center of the magnet roller 4*b* and the metal plate supporting member 202 to be within deviations of the metal plate supporting member 202, so that shifts in sliding positions in the radial direction can be reduced.

An urging means 206 is arranged for urging the magnet roller 4*b* from the opposite side to the side at which the contact spring 200 is attached, toward the direction of the side at which the contact spring 200 is attached (see arrow K). In this embodiment, the urging means 206 is used with a resin spring member 206*a*. In the magnet roller 4*b* receiving the urging force K, the end surface of the end shaft 4*b*1 on the side at which the contact spring 200 is attached, strikes a bottom surface of the fitting support hole formed in the supporting member 202 for the magnet roller 4*b*. The urging force of the magnet roller 4*b* normally urges the developing sleeve 4*a* via the supporting member 202. This prevents changing of the gap Z between the contact metal plate 201 supported the supporting member 202 as to contact with an inner surface of the developing sleeve 4*a* and the end surface 4*b*2 of the magnet roller 4*b*. Therefore, the contracted amount of the contact spring 200 is not changed, and a constant contact pressure can be always guaranteed.

A journal portion 4*a*1 of the developing sleeve 4*a* is supported by a bearing 4*i* as a bearing portion. In FIG. 8, numeral 4*f* is a developing container, and numeral 205 is a gear transmitting the drive force to the developing sleeve 4*a*.

In the embodiment, as FIG. 5 or FIG. 9, an elastic member 101 is provided at the developing container 4*f* as to be in contact with the developing sleeve 4*a* adjacent the limiting blade 4*c* on an end side in the longitudinal direction of the developing sleeve 4*a* with respect to the sealing member 100.

In this embodiment, a material substantially the same as that of the sealing member 100 is used for the elastic member 101, but the material of the elastic member 101 is not needed to be the same material of the sealing member 100 as far as it is of an elastic body.

The elastic member 101 is disposed at two locations in the longitudinal direction of the developing sleeve 4*a*, and is disposed at the nearest portion to the bearing 4*i* of the developing sleeve 4*a* as well as at the nearest portion to an proximal end of the journal portion 4*a*1. The elastic member 101 is located outside of the sealing member 100.

With the elastic member 101 thus formed, the developing sleeve 4*a* is supported by the elastic member 101 during logistic operations, and thereby is prevented from subjecting to bending or deformation. By providing the elastic member 101 adjacent to the limiting blade 4*c*, the SB gap is prevented from changing. This prevents the developing sleeve 4*a* from receiving damages due to contacts to the limiting blade 4*c* or the like.

As described above, according to the invention, the gap between the developing agent carrier and the layer thickness limiting member can be prevented from changing.

What is claimed is:

1. A developing apparatus for developing an electrostatic latent image formed on an electrophotographic photosensitive drum by use of a developing agent, comprising:

a developing agent carrier configured and positioned to supply the developing agent to the photosensitive drum to develop the electrostatic latent image formed on the photosensitive drum;

a layer thickness limiting member configured and positioned to limit a layer thickness of the developing agent carried on a surface of said developing agent carrier, said layer thickness limiting member being disposed to form a gap with said developing agent carrier;

a sealing member configured and positioned to restrict the developing agent from leaking out of an end in a longitudinal direction of said developing agent carrier; and an elastic member arranged to be in contact with said developing agent carrier to prevent the gap between said developing agent carrier and said layer thickness limiting member from changing upon bending of said developing agent carrier, wherein said elastic member is in contact with said developing agent carrier at an outer position in the longitudinal direction with respect to a position at which said sealing member is disposed.

2. The developing apparatus according to claim 1, wherein said elastic member is structured to comprise a plurality of layers.

3. The developing apparatus according to claim 2, wherein the plurality of layers is structured to comprise a surface layer made of a felt and a second layer made of an elastic body.

4. The developing apparatus according to claim 1, 2, or 3, wherein said elastic member is in contact with said developing agent carrier between a bearing at which said developing agent carrier is supported and said sealing member in the longitudinal direction.

5. The developing apparatus according to claim 1, wherein said sealing member is structured to comprise a surface layer made of a felt and a second layer made of an elastic body.

6. A process cartridge detachably mountable to a main assembly of an electrophotographic image forming apparatus, comprising:

an electrophotographic photosensitive drum;

a developing agent carrier configured and positioned to supply a developing agent to said photosensitive drum to develop an electrostatic latent image formed on said photosensitive drum by use of the developing agent;

a layer thickness limiting member configured and positioned to limit a layer thickness of the developing agent carried on a surface of said developing agent carrier, said layer thickness limiting member being disposed to form a gap with said developing agent carrier;

a sealing member configured and positioned to restrict the developing agent from leaking out of an end in a longitudinal direction of said developing agent carrier; and an elastic member arranged to be in contact with said developing agent carrier to prevent the gap between said developing agent carrier and said layer thickness limiting member from changing upon bending of said developing agent carrier, wherein said elastic member is in contact with said developing agent carrier at an outer position in the longitudinal direction with respect to a position at which said sealing member is disposed.

7. The process cartridge according to claim 6, wherein said elastic member is structured to comprise a plurality of layers.

8. The process cartridge according to claim 7, wherein the plurality of layers is structured to comprise a surface layer made of a felt and a second layer made of an elastic body.

9. The process cartridge according to claim 6, 7, or 8, wherein said elastic member is in contact with said developing agent carrier between a bearing at which said developing agent carrier is supported and said sealing member in the longitudinal direction.

10. The process cartridge according to claim 6, wherein said sealing member is structured to comprise a surface layer made of a felt and a second layer made of an elastic body.

11. An electrophotographic image forming apparatus for forming an image on a recording medium, comprising:

(i) mounting means for detachably mounting a process cartridge including:

an electrophotographic photosensitive drum;

a developing agent carrier configured and positioned to supply a developing agent to the photosensitive drum to develop an electrostatic latent image formed on the photosensitive drum by use of the developing agent;

a layer thickness limiting member configured and positioned to limit a layer thickness of the developing agent carried on a surface of the developing agent carrier, the layer thickness limiting member being disposed to form a gap with the developing agent carrier;

a sealing member configured and positioned to restrict the developing agent from leaking out of an end in a longitudinal direction of the developing agent carrier; and an elastic member arranged to be in contact with the developing agent carrier to prevent the gap between the developing agent carrier and the layer thickness limiting member from changing, wherein the elastic member is in contact with the developing agent carrier at an outer position in the longitudinal direction with respect to a position at which the sealing member is disposed; and (ii) feeding means for feeding the recording medium.

12. An electrophotographic image forming apparatus for forming an image on a recording medium, comprising:

an electrophotographic photosensitive drum;

a developing agent carrier configured and positioned to supply a developing agent to said photosensitive drum to develop an electrostatic latent image formed on said photosensitive drum by use of the developing agent;

a layer thickness limiting member configured and positioned to limit a layer thickness of the developing agent carried on a surface of said developing agent carrier, said layer thickness limiting member being disposed to form a gap with said developing agent carrier;

a sealing member configured and positioned to restrict the developing agent from leaking out of an end in a longitudinal direction of said developing agent carrier;

an elastic member arranged to be in contact with said developing agent carrier to prevent the gap between said developing agent carrier and said layer thickness limiting member from changing, wherein said elastic member contacts said developing agent carrier at an outer position in the longitudinal direction with respect to a position at which said sealing member is disposed; and feeding means for feeding the recording medium.

* * * * *

UNITED STATES PATENT AND TRADEMARK OFFICE

CERTIFICATE OF CORRECTION

PATENT NO. : 6,978,099 B2
APPLICATION NO. : 10/654909
DATED : December 20, 2005
INVENTOR(S) : Takahito Ueno et al.

It is certified that error appears in the above-identified patent and that said Letters Patent is hereby corrected as shown below:

ON THE COVER PAGE

At (75) Inventors:
"Masahide Kinoshita, Shizuka-ken (JP);" should read
--Masahide Kinoshita, Shizuoka-ken (JP);--.

COLUMN 4:
Line 64, "an" should read --a--.

COLUMN 5:
Line 41, "contacting" should read --contacts--.
Line 60, "5K" should read --5K)--.

COLUMN 6:
Line 2, "are" should read --is--.
Line 8, "upon" should read --upon being--.
Line 29, "alternative" should read --alternating--.
Line 32, "alternative" should read --alternating--; and "an" (second occurrence) should read --a--.
Line 41, "lower" should read --is lower--.

COLUMN 7:
Line 28, "drives" should be deleted.
Line 63, "process." should read --process. ¶ A cleaning unit 55 capable of contacting the surface of the belt 54a is provided at a prescribed position of the belt 54a as the most downstream side of the transfer process. The unit 55 is for removing transfer remaining toner remaining after the secondary transfer out the belt 54a. --.

COLUMN 8:
Line 23, "fig" should read --fixing--.
Line 44, "an" should read --a--.
Line 66, "ping" should read --pulling--.

COLUMN 9:
Line 57, "upon" should read --upon being--.

UNITED STATES PATENT AND TRADEMARK OFFICE

CERTIFICATE OF CORRECTION

PATENT NO. : 6,978,099 B2
APPLICATION NO. : 10/654909
DATED : December 20, 2005
INVENTOR(S) : Takahito Ueno et al.

It is certified that error appears in the above-identified patent and that said Letters Patent is hereby corrected as shown below:

COLUMN 10:
Line 45, "far" should read --long--.
Line 54, "subjecting" should read --being subjected--.

Signed and Sealed this

Twenty-ninth Day of August, 2006

JON W. DUDAS
*Director of the United States Patent and Trademark Office*